US008907755B2

(12) United States Patent
Katayama et al.

(10) Patent No.: US 8,907,755 B2
(45) Date of Patent: Dec. 9, 2014

(54) R-T-B-BASED RARE EARTH MAGNET PARTICLES, PROCESS FOR PRODUCING THE R-T-B- BASED RARE EARTH MAGNET PARTICLES, AND BONDED MAGNET

(71) Applicant: Toda Kogyo Corp., Otake-shi, Hiroshima-ken (JP)

(72) Inventors: Nobuhiro Katayama, Otake (JP); Hirofumi Kawasaki, Otake (JP); Koichiro Morimoto, Otake (JP)

(73) Assignee: Toda Kogyo Corporation, Otake-shi, Hiroshima-ken (JP)

( * ) Notice: Subject to any disclaimer, the term of this patent is extended or adjusted under 35 U.S.C. 154(b) by 141 days.

(21) Appl. No.: 13/835,754

(22) Filed: Mar. 15, 2013

(65) Prior Publication Data

US 2013/0265128 A1 Oct. 10, 2013

(30) Foreign Application Priority Data

Mar. 30, 2012 (JP) ..... 2012-78723

(51) Int. Cl.

| | |
|---|---|
| ***H01F 7/02*** | (2006.01) |
| ***H01F 1/00*** | (2006.01) |
| ***H01F 1/057*** | (2006.01) |
| ***H01F 1/01*** | (2006.01) |
| ***H01F 41/00*** | (2006.01) |

(52) U.S. Cl.

CPC ..... *H01F 7/02* (2013.01); *H01F 1/0573* (2013.01); *H01F 1/0578* (2013.01); *H01F 1/01* (2013.01); *H01F 41/005* (2013.01)

USPC ..... 335/302; 148/302

(58) Field of Classification Search

None

See application file for complete search history.

(56) References Cited

U.S. PATENT DOCUMENTS

| | | | | |
|---|---|---|---|---|
| 7,371,292 | B2 * | 5/2008 | Shimada et al. | 148/302 |
| 7,431,070 | B2 * | 10/2008 | Hasegawa et al. | 164/463 |
| 7,846,273 | B2 * | 12/2010 | Sasaki et al. | 148/302 |
| 2007/0175544 | A1 * | 8/2007 | Hasegawa et al. | 148/101 |
| 2011/0025440 | A1 * | 2/2011 | Kuniyoshi et al. | 335/302 |

* cited by examiner

*Primary Examiner* — Alexander Talpalatski

(74) *Attorney, Agent, or Firm* — Nixon & Vanderhye P.C.

(57) ABSTRACT

R-T-B-based rare earth magnet particles are produced by an HDDR treatment which comprises a first stage HD step of heating particles of a raw material alloy having a composition of R, B and Co in an inert atmosphere or in a vacuum atmosphere and then replacing the atmosphere with a hydrogen-containing gas atmosphere in which the raw material alloy particles are held in the same temperature range and a second stage HD step of heating a material obtained in the first stage HD step in which the material is held in the hydrogen-containing gas atmosphere.

4 Claims, 1 Drawing Sheet

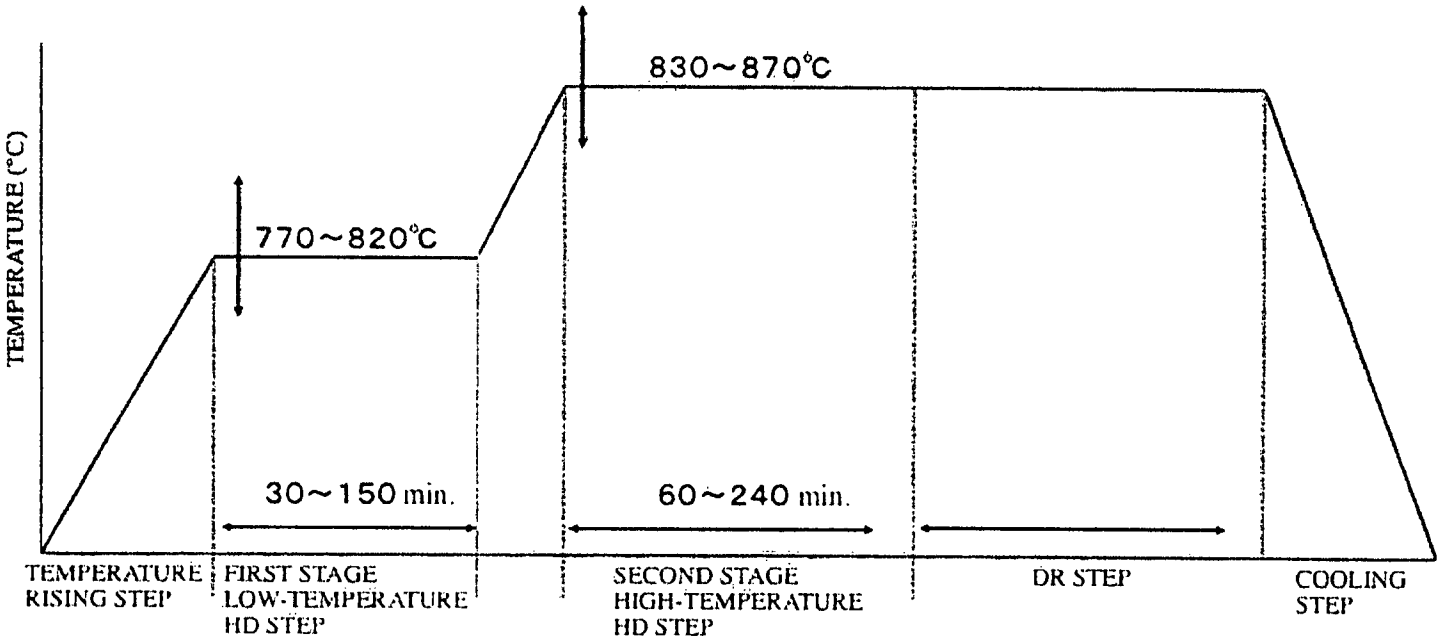
TEMPERATURE (°C)
830~870°C
770~820°C
30~150 min.
60~240 min.
TEMPERATURE RISING STEP
FIRST STAGE LOW-TEMPERATURE HD STEP
SECOND STAGE HIGH-TEMPERATURE HD STEP
DR STEP
COOLING STEP

R-T-B-BASED RARE EARTH MAGNET PARTICLES, PROCESS FOR PRODUCING THE R-T-B- BASED RARE EARTH MAGNET PARTICLES, AND BONDED MAGNET

TECHNICAL FIELD

The present invention relates to R-T-B-based rare earth magnet particles.

BACKGROUND OF THE INVENTION

R-T-B-based rare earth magnet particles have excellent magnetic properties and have been extensively used in the industrial applications such as magnets for various motors employed in automobiles, etc. However, the magnet particles produced by a hydrogenation-disproportionation-desorption-recombination process (HDDR treatment) have a non-uniform decomposition structure formed by the hydrogenation/phase decomposition process and therefore exhibit a poor squareness of a demagnetization curve thereof, so that it has been difficult for the magnet particles to satisfy both an excellent residual magnetic flux density and an excellent coercive force.

In Japanese Patent Application Laid-Open (KOKAI) No. 6-128610 and Japanese Patent Application Laid-Open (KOKAI) No. 2003-301203, there is described the process for producing R-T-B-based rare earth magnet particles by HDDR treatment in which hydrogen is introduced subsequent to temperature rise step. However, since temperature control of a hydrogenation-disproportionation step (HD step) of the process is insufficient, the resulting magnet tends to exhibit a low coercive force, so that it has been difficult to obtain magnet particles capable of satisfying both an excellent residual magnetic flux density and an excellent coercive force.

SUMMARY OF THE INVENTION

Problem to be Solved by the Invention

Thus, the R-T-B-based rare earth magnet particles produced by the conventional methods have a non-uniform decomposition structure formed by the hydrogenation/phase decomposition process and therefore exhibit a poor squareness of a demagnetization curve thereof, so that it has been difficult to satisfy both an excellent residual magnetic flux density and an excellent coercive force. In particular, the R-T-B-based rare earth magnet particles have such a problem that among the magnet particles, small particles having a large specific surface area which are likely to suffer from non-uniform crystal orientation may exhibit a considerably low residual magnetic flux density.

Means for the Solution of the Subject

An object of the present invention is to provide a process for producing R-T-B-based rare earth magnet particles in which by well controlling treating conditions of an HD step in an HDDR treatment and forming a uniform decomposition structure, it is possible to suppress deterioration in residual magnetic flux density of small particles therein and obtain magnet particles having a high squareness which are capable of satisfying both an excellent residual magnetic flux density and an excellent coercive force.

That is, according to the present invention, there is provided a process for producing R-T-B-based rare earth magnet particles by HDDR treatment, comprising:

a first stage HD step of heating particles of a raw material alloy to a temperature range of not lower than 770° C. and not higher than 820° C. in an inert atmosphere or in a vacuum atmosphere and then replacing the atmosphere with a hydrogen-containing gas atmosphere in which the raw material alloy particles are held in the same temperature range for not shorter than 30 min and not longer than 150 min, said raw material alloy comprising R (wherein R represents at least one rare earth element including Y), T (wherein T represents Fe, or Fe and Co) and B (wherein B represents boron), and having a composition comprising R in an amount of not less than 12.5 atom % and not more than 14.3 atom %, B in an amount of not less than 4.5 atom % and not more than 7.5 atom % and Co in an amount of not more than 10.0 atom %; and a second stage HD step of heating a material obtained in the first stage HD step again to a temperature range of not lower than 830° C. and not higher than 870° C. in which the material is held in the hydrogen-containing gas atmosphere for not shorter than 60 min and not longer than 240 min (Invention 1).

Also, according to the present invention, there is provided the process for producing R-T-B-based rare earth magnet particles as described in the above Invention 1, wherein the raw material alloy further comprises Ga and Zr, and has a composition comprising Ga in an amount of not less than 0.1 atom % and not more than 1.0 atom % and Zr in an amount of not less than 0.05 atom % and not more than 0.15 atom % (Invention 2).

In addition, according to the present invention, there are provided R-T-B-based rare earth magnet particles comprising R (wherein R represents at least one rare earth element including Y), T (wherein T represents Fe, or Fe and Co) and B (wherein B represents boron), and having a composition comprising R in an amount of not less than 12.5 atom % and not more than 14.3 atom %, B in an amount of not less than 4.5 atom % and not more than 7.5 atom % and Co in an amount of not more than 10.0 atom %, in which a squareness ($H_k/H_{cJ}$) of a demagnetization curve of the R-T-B-based rare earth magnet particles is not less than 0.5, and a difference $DB_r$ between a residual magnetic flux density ($B_{r106}$) of oversize particles obtained therefrom using a sieve of sieve opening 106 mm and a residual magnetic flux density ($B_{r38}$) of undersize particles obtained therefrom using a sieve of sieve opening 38 mm is not more than 0.02T (Invention 3).

Further, according to the present invention, there is provided a bonded magnet comprising the R-T-B-based rare earth magnet particles as described in the above Invention 3 (Invention 4).

Effect of the Invention

In accordance with the present invention, by well controlling treating conditions of an HD step in an HDDR treatment, it is possible to obtain R-T-B-based rare earth magnet particles having excellent magnetic properties.

BRIEF DESCRIPTION OF THE DRAWING

FIG. 1 is a temperature pattern of an HDDR treatment process.

DETAILED DESCRIPTION OF THE INVENTION

The process for producing R-T-B-based rare earth magnet particles according to the present invention is explained in detail below. In the process for producing R-T-B-based rare earth magnet particles according to the present invention, raw material alloy particles are subjected to an HDDR treatment, and the resulting particles are cooled to obtain the R-T-B-based rare earth magnet particles.

First, a raw material alloy for the R-T-B-based rare earth magnet particles according to the present invention is explained.

The raw material alloy for the R-T-B-based rare earth magnet particles as used in the present invention comprises R (wherein R represents at least one rare earth element including Y), T (wherein T represents Fe, or Fe and Co) and B (wherein B represents boron).

As the rare earth element R constituting the raw material alloy for the R-T-B-based rare earth magnet particles according to the present invention, there may be used at least one element selected from the group consisting of Y, La, Ce, Pr, Nd, Pm, Sm, Eu, Gd, Tb, Dy, Ho, Er, Tm, Yb and Lu. Among these rare earth elements, from the standpoint of costs and magnetic properties, Nd is preferably used. The content of the element R in the raw material alloy is not less than 12.5 atom % and not more than 14.3 atom %. When the content of the element R in the raw material alloy is more than 14.3 atom %, the raw material alloy tends to comprise a non-magnetic phase in a considerably large amount so that the obtained magnet particles tend to exhibit a low residual magnetic flux density. The content of the element R in the raw material alloy is preferably not less than 12.8 atom % and not more than 14.0 atom %.

As the element T constituting the raw material alloy for the R-T-B-based rare earth magnet particles according to the present invention, there is mentioned Fe, or Fe and Co. The content of the element T in the raw material alloy is the balance of the raw material alloy except for the other elements constituting the raw material alloy. In addition, when Co is added as an element with which Fe is to be substituted, it is possible to raise a Curie temperature of the raw material alloy. However, the addition of Co to the raw material alloy tends to induce deterioration in residual flux density of the resulting magnet particles. Therefore, the content of Co in the raw material alloy is controlled to not more than 10 atom % and preferably not more than 8.0 atom %.

The content of B in the raw material alloy for the R-T-B-based rare earth magnet particles according to the present invention is not less than 4.5 atom % and not more than 7.5 atom %. When the content of B in the raw material alloy is less than 4.5 atom %, an $R_2T_{17}$ phase and the like tend to be precipitated, so that the resulting magnet particles tend to be deteriorated in magnetic properties. When the content of B in the raw material alloy is more than 7.5 atom %, the resulting magnet particles tend to exhibit a low residual magnetic flux density. The content of B in the raw material alloy is preferably not less than 5.0 atom % and not more than 7.0 atom %.

In addition, the raw material alloy for the R-T-B-based rare earth magnet particles according to the present invention preferably further comprises Ga and Zr. The content of Ga in the raw material alloy is preferably not less than 0.1 atom % and not more than 1.0 atom %. When the content of Ga in the raw material alloy is less than 0.1 atom %, the effect of improving a coercive force of the resulting magnet particles tends to be low. When the content of Ga in the raw material alloy is more than 1.0 atom %, the resulting magnet particles tend to be deteriorated in residual magnetic flux density. In addition, the content of Zr in the raw material alloy is preferably not less than 0.05 atom % and not more than 0.15 atom %. When the content of Zr in the raw material alloy is less than 0.05 atom %, the effect of improving a coercive force of the resulting magnet particles tends to be low. When the content of Zr in the raw material alloy is more than 0.15 atom %, the resulting magnet particles tend to be deteriorated in residual magnetic flux density.

Further, the raw material alloy for the R-T-B-based rare earth magnet particles according to the present invention may also comprise, in addition to the above-mentioned elements, at least one element selected from the group consisting of Ti, Al, V, Nb, Cu, Si, Cr, Mn, Zn, Mo, Hf, W, Ta and Sn. When adding these elements to the raw material alloy, it is possible to enhance magnetic properties of the resulting R-T-B-based rare earth magnet particles. The total content of these elements in the raw material alloy is preferably not more than 4.5 atom %. When the total content of these elements in the raw material alloy is more than 4.5 atom %, the resulting magnet particles tend to be deteriorated in residual magnetic flux density or suffer from precipitation of the other phases.

(Production of Raw Material Alloy Particles)

As the raw material alloy for the R-T-B-based rare earth magnet particles, there may be used ingots produced by a book mold casting method or a centrifugal casting method, or strips produced by a strip casting method. These alloys tend to undergo segregation of its composition upon the casting, and therefore may be subjected to homogenization heat treatment for the composition before subjected to the HDDR treatment. The homogenization heat treatment may be carried out in a vacuum atmosphere or in an inert gas atmosphere at a temperature of preferably not lower than 950° C. and not higher than 1200° C. and more preferably not lower than 1000° C. and not higher than 1170° C. Next, the raw material alloy is subjected to coarse pulverization and fine pulverization to thereby produce raw material alloy particles for the HDDR treatment. The coarse pulverization may be carried out using a jaw crusher or the like. Thereafter, the resulting particles may be subjected to ordinary hydrogen absorbing pulverization and mechanical pulverization to thereby produce raw material alloy particles for the R-T-B-based rare earth magnet particles. The raw material alloy particles preferably have an average particle diameter of 30 to 200 pm.

Next, the process for producing the R-T-B-based rare earth magnet particles from the raw material alloy particles is explained.

(HDDR Treatment)

The HDDR treatment includes an HD step in which an R-T-B-based raw material alloy is subjected to hydrogenation to decompose the alloy into an a-Fe phase, an $RH_2$ phase and an $Fe_2B$ phase, and a desorption-recombination process (DR step) in which hydrogen is discharged under reduced pressure so that a reverse reaction of the above step is caused to produce $R_2T_{14}B$ from the respective phases. In the present invention, the HD step includes a first stage HD step and a second stage HD step. In the first stage HD step, the raw material alloy is subjected to hydrogenation/phase decomposition process to form a fine initial decomposition structure. Then, in the second stage HD step, the thus formed structure was uniformly grown. As a result, it is possible to obtain a uniform decomposition structure and thereby produce magnet particles having an excellent squareness.

(First Stage HD Step)

The first stage HD step is carried out in a hydrogen-containing gas atmosphere after heating the raw material alloy particles in an inert atmosphere or in a vacuum atmosphere. The hydrogen-containing gas atmosphere is preferably a mixed gas atmosphere of a hydrogen gas having a hydrogen partial pressure of not less than 20 kPa and not more than 90 kPa, and an inert gas. The hydrogen partial pressure in the hydrogen-containing gas atmosphere is more preferably not less than 40 kPa and not more than 80 kPa. The reason therefor is as follows. That is, when the hydrogen partial pressure is less than 20 kPa, the reaction tends to hardly proceed, whereas when the hydrogen partial pressure is more than 90 kPa, the reactivity tends to become excessively high, so that the resulting magnet particles tend to be deteriorated in magnetic properties.

The raw material alloy particles are heated to a temperature range of not lower than 770° C. and not higher than 820° C., preferably not lower than 780° C. and not higher than 810° C., in an inert atmosphere or in a vacuum atmosphere, and then the atmosphere is replaced with the hydrogen-containing gas atmosphere in which the raw material alloy particles are held in the same temperature range for not shorter than 30 min and not longer than 150 min, preferably for not shorter than 60 min and not longer than 120 min. When the introduction temperature is lower than 770° C., although the resulting particles tends to be increased in coercive force owing to formation of a fine decomposition structure, the decomposition phase tends to be insufficient in crystal orientation so that the resulting particles tend to be deteriorated in residual magnetic flux density. In particular, among the particles, small particles having a large specific surface area which are likely to suffer from non-uniform crystal orientation tend to be remarkably deteriorated in residual magnetic flux density. On the other hand, when the introduction temperature is higher than 820° C., crystal orientation of the resulting particles tends to become sharp owing to formation of a large decomposition phase, so that the resulting particles tend to be increased in residual magnetic flux density. However, in such a case, the resulting particles tend to be considerably deteriorated in coercive force owing to formation of the coarse decomposition structure. The hydrogenation/phase decomposition process is accompanied with generation of heat. In the case where the generation of heat is terminated, the hydrogenation/phase decomposition process is also terminated so that the decomposition structure is formed. When the treating time is shorter than 30 min, the generation of heat is not terminated, and therefore the hydrogenation/phase decomposition process is not completed, so that growth of the decomposition structure tends to be insufficient. As a result, although a high coercive force of the resulting particles tends to be maintained, crystal orientation of the decomposition phase tends to hardly proceed, so that the resulting particles tend to be deteriorated in residual magnetic flux density. In particular, among the particles, small particles having a large specific surface area which are likely to suffer from non-uniform crystal orientation tend to be remarkably deterioration in residual magnetic flux density. On the other hand, when the treating time is longer than 150 min, crystal orientation of the resulting particles tends to become sharp owing to growth of the decomposition phase, so that the resulting particles tend to be increased in residual magnetic flux density. However, in such a case, the resulting particles tend to be considerably deteriorated in coercive force due to formation of the coarse decomposition structure.

(Second Stage HD Step)

After completion of the first stage HD step, the second stage HD step is carried out in such a manner that the particles obtained in the previous step are heated again to a temperature range of not lower than 830° C. and not higher than 870° C. and preferably not lower than 835° C. and not higher than 855° C. in the hydrogen-containing gas atmosphere and held in such a temperature range for not shorter than 60 min and not longer than 240 min and preferably for not shorter than 70 min and not longer than 200 min. When the holding temperature is lower than 830° C., growth of the decomposition structure tends to be insufficient. As a result, although a high coercive force of the resulting particles tends to be maintained, crystal orientation thereof tends to hardly proceed so that the resulting particles tend to be deteriorated in residual magnetic flux density. In particular, among the particles, small particles having a large specific surface area which are likely to suffer from non-uniform crystal orientation tend to be remarkably deteriorated in residual magnetic flux density. On the other hand, when the holding temperature is higher than 870° C., crystal orientation of the resulting particles tends to become sharp owing to growth of the decomposition phase, so that the resulting particles tend to be increased in residual magnetic flux density. However, in such a case, the resulting particles tend to be considerably deteriorated in coercive force due to formation of the coarse decomposition structure. When the treating time is shorter than 60 min, growth of the decomposition structure tends to be insufficient. As a result, although a high coercive force of the resulting particles tends to be maintained, crystal orientation of the decomposition phase tends to hardly proceed so that the resulting particles tend to be deteriorated in residual magnetic flux density. In particular, among the particles, small particles having a large specific surface area which are likely to suffer from non-uniform crystal orientation tend to be remarkably deteriorated in residual magnetic flux density. On the other hand, when the treating time is longer than 240 min, crystal orientation of the resulting particles tends to become sharp owing to growth of the decomposition phase, so that the resulting particles tend to be increased in residual magnetic flux density. However, in such a case, the resulting particles tend to be considerably deteriorated in coercive force due to formation of the coarse decomposition structure.

(DR Step)

The DR step is conducted at a treating temperature of not lower than 800° C. and not higher than 900° C. and preferably not lower than 810° C. and not higher than 870° C. The reason why the treating temperature is adjusted to not lower than 800° C. is that when the treating temperature is lower than 800° C., dehydrogenation tends to hardly proceed. Whereas, the reason why the treating temperature is adjusted to not higher than 900° C. is that when the treating temperature is higher than 900° C., the resulting particles tends to be deteriorated in coercive force owing to growth of crystal grains. In the DR step, the vacuum degree is finally adjusted to not more than 1 Pa. The treating time is usually not shorter than 15 min and not longer than 300 min.

After completion of the DR step, the resulting magnet particles are cooled. Upon the cooling step, the magnet particles are rapidly cooled in argon (Ar). As a result, the magnet particles can be prevented from suffering from growth of crystal grains.

Next, the R-T-B-based rare earth magnet particles according to the present invention are explained.

The R-T-B-based rare earth magnet particles according to the present invention comprise R (wherein R represents at least one rare earth element including Y), T (wherein T represents Fe, or Fe and Co) and B (wherein B represents boron).

As the rare earth element R constituting the R-T-B-based rare earth magnet particles according to the present invention, there may be used at least one element selected from the group consisting of Y, La, Ce, Pr, Nd, Pm, Sm, Eu, Gd, Tb, Dy, Ho, Er, Tm, Yb and Lu. Among these rare earth elements, from the standpoint of costs and magnetic properties, Nd is preferably used. The content of the element R in the magnet particles is not less than 12.5 atom % and not more than 14.3 atom %. When the content of the element R in the magnet particles is less than 12.5 atom %, the effect of improving a coercive force of the magnet particles tends to be insufficient. When the content of the element R in the magnet particles is more than 14.3 atom %, the magnet particles tend to exhibit a low residual magnetic flux density. The content of the element R in the magnet particles is preferably not less than 12.8 atom % and not more than 14.0 atom %.

As the element T constituting the R-T-B-based rare earth magnet particles according to the present invention, there is mentioned Fe, or Fe and Co. The content of the element T in the magnet particles is the balance of the magnet particles except for the other elements constituting the magnet particles. In addition, when Co is added as an element with which Fe is to be substituted, it is possible to raise a Curie temperature of the magnet particles. However, the addition of Co to the magnet particles tends to induce deterioration in residual flux density of the magnet particles. Therefore, the content of Co in the magnet particles is controlled to not more than 10.0 atom % and preferably not more than 8.0 atom %.

The content of B in the composition of the R-T-B-based rare earth magnet particles according to the present invention is not less than 4.5 atom % and not more than 7.5 atom %. When the content of B in the magnet particles is less than 4.5 atom %, an $R_2T_{17}$ phase and the like tend to be precipitated, so that the resulting magnet particles tend to be deteriorated in magnetic properties. When the content of B in the magnet particles is more than 7.5 atom %, the resulting magnet particles tend to exhibit a low residual magnetic flux density. The content of B in the magnet particles is preferably not less than 5.0 atom % and not more than 7.0 atom %.

In addition, the R-T-B-based rare earth magnet particles according to the present invention preferably further comprise Ga and Zr. The content of Ga in the magnet particles is preferably not less than 0.1 atom % and not more than 1.0 atom %. When the content of Ga in the magnet particles is less than 0.1 atom %, the effect of improving a coercive force of the resulting magnet particles tends to be low. When the content of Ga in the magnet particles is more than 1.0 atom %, the resulting magnet particles tend to be deteriorated in residual magnetic flux density. In addition, the content of Zr in the magnet particles is preferably not less than 0.05 atom % and not more than 0.15 atom %. When the content of Zr in the magnet particles is less than 0.05 atom %, the effect of improving a coercive force of the resulting magnet particles tends to be low. When the content of Zr in the magnet particles is more than 0.15 atom %, the resulting magnet particles tend to be deteriorated in residual magnetic flux density.

Further, the R-T-B-based rare earth magnet particles according to the present invention may also comprise, in addition to the above-mentioned elements, at least one element selected from the group consisting of Ti, Al, V, Nb, Cu, Si, Cr, Mn, Zn, Mo, Hf, W, Ta and Sn. When adding these elements to the magnet particles, it is possible to enhance magnetic properties of the resulting R-T-B-based rare earth magnet particles. The total content of these elements in the magnet particles is preferably not more than 4.5 atom % and preferably not more than 3.0 atom %. When the total content of these elements in the magnet particles is more than 4.5 atom %, the resulting magnet particles tend to be deteriorated in residual magnetic flux density.

The squareness ($H_k/H_{cJ}$) of a demagnetization curve of the R-T-B-based rare earth magnet particles according to the present invention is not less than 0.5. In the present invention, by well controlling the treating conditions of the HD step, the obtained R-T-B-based rare earth magnet particles are excellent in residual magnetic flux density and coercive force, and have a squareness ($H_k/H_{cJ}$) of not less than 0.5.

In the R-T-B-based rare earth magnet particles according to the present invention, the difference $\Delta B_r$ between a residual magnetic flux density ($B_{r106}$) of oversize particles obtained therefrom using a sieve of sieve opening 106 mm and a residual magnetic flux density ($B_{r38}$) of undersize particles obtained therefrom using a sieve of sieve opening 38 mm is not more than 0.02T. In the present invention, the treating conditions of the HD step can be well controlled, and deterioration in residual magnetic flux density of small particles can be suppressed by formation of the uniform decomposition structure, so that the $\Delta B_r$ value can be adjusted to not more than 0.02T. The $\Delta B_r$ value is preferably not more than 0.015T and more preferably not more than 0.01T.

(Production of Bonded Magnet)

The R-T-B-based rare earth magnet particles according to the present invention can be used to produce a bonded magnet therefrom. The magnet particles are mixed and kneaded with a thermoplastic resin, a coupling agent and a lubricant, and then the resulting kneaded material is subjected to compression molding, injection molding or the like in a magnetic field, so that it is possible to produce a bonded magnet. Alternatively, the magnet particles may be mixed with a thermosetting resin such as an epoxy resin, and the resulting mixture may be subjected to pressure molding or the like and then to heat treatment to thereby produce a bonded magnet.

EXAMPLES

In the following, the present invention is described in more detail by Examples. However, these Examples are only illustrative and not intended to limit the present invention thereto.

As magnetic properties of the R-T-B-based rare earth magnet particles according to the present invention, a coercive force ($H_{cJ}$), a maximum energy product ($(BH)_{max}$), a residual magnetic flux density ($B_r$) and a squareness ($H_k/H_{cJ}$) of the magnet particles were measured using a vibrating sample type magnetic flux meter (VSM: "VSM-5 Model") manufactured by Toei Kogyo K.K.

The residual magnetic flux density ($B_{r106}$) of oversize particles obtained from the magnet particles using a sieve of sieve opening 106 mm and the residual magnetic flux density ($B_{r38}$) of undersize particles obtained therefrom using a sieve of sieve opening 38 mm were measured as follows. That is, a sample was charged into the respective sieves having the above mesh sizes, and the respective sieves were vibrated at an oscillation frequency of 75 Hz for 15 min using a sieve vibrator to measure a residual magnetic flux density of the oversize particles or undersize particles of the sample with respect to the respective sieves. The difference between the residual magnetic flux density ($B_{r106}$) of the oversize particles obtained using the sieve of sieve opening 106 mm and the residual magnetic flux density ($B_{r38}$) of the undersize particles obtained using the sieve of sieve opening 38 mm was expressed by $DB_r$.

(Production of Raw Material Alloy Particles)

An alloy ingot having a composition shown in Table 1 below was produced. The thus produced alloy ingot was subjected to heat treatment in a vacuum atmosphere at 1150° C. for 20 hr to obtain a homogenized composition. After completion of the homogenization heat treatment, the resulting particles were subjected to coarse pulverization using a jaw crusher, and further to hydrogen absorption and then mechanical pulverization, thereby obtaining raw material alloy particles. The raw material alloy particles had a particle diameter of not more than 150 μm such that an average particle diameter of the particles was 70 μm.

TABLE 1

| | Nd | Fe | Co | B | Ga | Al | Zr |
|---|---|---|---|---|---|---|---|
| Composition of raw material alloy* | 12.9 | Bal. | 5.8 | 6.2 | 0.5 | 1.5 | 0.1 |

Note
*Unit: atom %

Example 1

(HDDR Treatment: First Stage HD Step)

Five kilograms of the raw material alloy particles were charged into a furnace to subject the particles to the first stage HD step. In the first stage HD step, an inside atmosphere of the furnace was set to an Ar atmosphere, and the raw material alloy particles were heated to 780° C. in the Ar atmosphere. Thereafter, the particles were held in a mixed gas of hydrogen and Ar maintained under a total pressure of 100 kPa (atmospheric pressure) having a hydrogen partial pressure of 60 kPa for 80 min.

(HDDR Treatment: Second Stage HD Step)

After completion of the first stage HD step, in the second stage HD step, the particles obtained in the first stage HD step were heated to 840° C. in the same atmosphere as used in the first stage HD step, and thereafter held at the same temperature for 120 min.

(HDDR Treatment: DR Step)

After completion of the HD step, an inside of the furnace was evacuated using a rotary pump while maintaining an inside temperature of the furnace at 840° C. The furnace was subjected to vacuum drawing until reaching 3.2 kPa and held under 3.2 kPa for 100 min, and then subjected to vacuum drawing until reaching 1.0 Pa or less and held under the condition for 45 min to remove hydrogen remaining in the particles. The resulting particles were cooled to obtain R-T-B-based rare earth magnet particles. The thus obtained R-T-B-based rare earth magnet particles still maintained substantially the same particle diameter as that of the raw material alloy particles.

Example 2

The same HDDR treatment as in Example 1 was conducted except that the holding time of the second stage HD step was changed to 180 min, thereby obtaining R-T-B-based rare earth magnet particles.

Example 3

The same HDDR treatment as in Example 1 was conducted except that the holding time of the first stage HD step was changed to 120 min, thereby obtaining R-T-B-based rare earth magnet particles.

Example 4

The same HDDR treatment as in Example 1 was conducted except that the holding temperature of the first stage HD step was changed to 810° C., thereby obtaining R-T-B-based rare earth magnet particles.

Example 5

The same HDDR treatment as in Example 1 was conducted except that the temperature rising step was carried out in a vacuum atmosphere, thereby obtaining R-T-B-based rare earth magnet particles.

Comparative Example 1

The same HDDR treatment as in Example 1 was conducted except that the holding temperature of the first stage HD step was changed to 760° C., thereby obtaining R-T-B-based rare earth magnet particles.

Comparative Example 2

The same HDDR treatment as in Example 1 was conducted except that the holding temperature of the first stage HD step was changed to 840° C., and the holding temperature of the second stage HD step was successively maintained at 840° C., thereby obtaining R-T-B-based rare earth magnet particles.

Comparative Example 3

The same HDDR treatment as in Example 1 was conducted except that the holding time of the second stage HD step was changed to 30 min, thereby obtaining R-T-B-based rare earth magnet particles.

Comparative Example 4

The same HDDR treatment as in Example 1 was conducted except that the atmosphere upon the temperature rise step was changed from Ar to a mixed gas of hydrogen and Ar maintained under a total pressure of 100 kPa (atmospheric pressure) having a hydrogen partial pressure of 60 kPa, thereby obtaining R-T-B-based rare earth magnet particles.

TABLE 2

| | Temperature | First stage HD step | |
|---|---|---|---|
| Sample No. | rise step Atmosphere upon temperature rise | Introduction temperature of hydrogen-containing gas (° C.) | Holding time (min) |
| Example 1 | Ar | 780 | 80 |
| Example 2 | Ar | 780 | 80 |
| Example 3 | Ar | 780 | 120 |
| Example 4 | Ar | 810 | 80 |
| Example 5 | In vacuum | 780 | 80 |
| Comparative Example 1 | Ar | 760 | 80 |
| Comparative Example 2 | Ar | 840 | 80 |
| Comparative Example 3 | Ar | 780 | 80 |
| Comparative Example 4 | Mixed atmosphere of $H_2$ and Ar | | 80 |

| | Second stage HD step | | Magnetic properties | | |
|---|---|---|---|---|---|
| Sample No. | Holding temperature (° C.) | Holding time (min) | $B_r$ (T) | $B_{r106}$ (T) | $B_{r38}$ (T) |
| Example 1 | 840 | 120 | 1.21 | 1.21 | 1.20 |
| Example 2 | 840 | 180 | 1.22 | 1.22 | 1.21 |
| Example 3 | 840 | 120 | 1.19 | 1.19 | 1.19 |
| Example 4 | 840 | 120 | 1.25 | 1.25 | 1.24 |

TABLE 2-continued

| | | | | | |
|---|---|---|---|---|---|
| Example 5 | 840 | 120 | 1.22 | 1.22 | 1.21 |
| Comparative Example 1 | 840 | 120 | 1.14 | 1.14 | 1.10 |
| Comparative Example 2 | 840 | 120 | 1.19 | 1.19 | 1.14 |
| Comparative Example 3 | 840 | 30 | 1.23 | 1.23 | 1.18 |
| Comparative Example 4 | 840 | 120 | 1.23 | 1.23 | 1.12 |

| | Magnetic properties | | | |
|---|---|---|---|---|
| Sample No. | $\Delta B_r$ (T) | $H_{cJ}$ (kA/m) | $(BH)_{max}$ (kJ/m$^3$) | $H_k/H_{cJ}$ (—) |
| Example 1 | 0.01 | 1310 | 268 | 0.57 |
| Example 2 | 0.01 | 1330 | 264 | 0.53 |
| Example 3 | 0.00 | 1290 | 253 | 0.54 |
| Example 4 | 0.01 | 1270 | 297 | 0.57 |
| Example 5 | 0.01 | 1320 | 259 | 0.52 |
| Comparative Example 1 | 0.04 | 1310 | 231 | 0.52 |
| Comparative Example 2 | 0.05 | 680 | 224 | 0.33 |
| Comparative Example 3 | 0.05 | 1100 | 210 | 0.45 |
| Comparative Example 4 | 0.11 | 1330 | 256 | 0.52 |

(Results)

As recognized from Table 2, the magnet particles obtained in Examples 1 to 5 all had a squareness of not less than 0.5. Also, the $\Delta B_r$ value of the magnet particles was not more than 0.02T, and the difference between the residual magnetic flux density values depending upon a particle size thereof was extremely small. In addition, the magnet particles had a coercive force of not less than 1270 A/m. Thus, the magnet particles obtained in Examples 1 to 5 were excellent in both residual magnetic flux density and coercive force. The reason therefor is considered to be that a uniform decomposition structure was formed in the HD step.

On the other hand, in Comparative Example 1 in which the gas introduction temperature was excessively low, the resulting magnet particles exhibited a low residual magnetic flux density although the coercive force thereof was high.

In Comparative Example 2 in which the gas introduction temperature was excessively high, it is suggested that since no hydrogenation/phase decomposition process of the structure proceeded, the structure was kept in a non-decomposed state, so that the resulting magnet particles had poor magnetic properties.

In Comparative Example 3 in which the holding time of the second stage HD step was excessively short, the resulting magnet particles exhibited a low coercive force value although the residual magnetic flux density thereof was high.

In Comparative Example 4, $\Delta B_r$ was as large as 0.11T. The reason therefor was considered to be that when the temperature was raised in the hydrogen-containing gas atmosphere, the hydrogenation/phase decomposition process of the particles was initiated from small particles thereamong, so that a fine decomposition structure was formed therein.

INDUSTRIAL APPLICABILITY

In the process for producing R-T-B-based rare earth magnet particles according to the present invention, by well controlling treating conditions of an HD step in an HDDR treatment, it is possible to obtain R-T-B-based rare earth magnet particles having a high squareness and excellent residual magnetic flux density and coercive force.

What is claimed is:

1. A process for producing R-T-B-based rare earth magnet particles by HDDR treatment, comprising:

a first stage HD step of heating particles of a raw material alloy to a temperature range of not lower than 770° C. and not higher than 820° C. in an inert atmosphere or in a vacuum atmosphere and then replacing the atmosphere with a hydrogen-containing gas atmosphere in which the raw material alloy particles are held in the same temperature range for not shorter than 30 min and not longer than 150 min, said raw material alloy comprising R (wherein R represents at least one rare earth element including Y), T (wherein T represents Fe, or Fe and Co) and B (wherein B represents boron), and having a composition comprising R in an amount of not less than 12.5 atom % and not more than 14.3 atom %, B in an amount of not less than 4.5 atom % and not more than 7.5 atom % and Co in an amount of not more than 10 atom %; and a second stage HD step of heating a material obtained in the first stage HD step again to a temperature range of not lower than 830° C. and not higher than 870° C. in which the material is held in the hydrogen-containing gas atmosphere for not shorter than 60 min and not longer than 240 min.

2. The process for producing R-T-B-based rare earth magnet particles according to claim 1, wherein the raw material alloy further comprises Ga and Zr, and has a composition comprising Ga in an amount of not less than 0.1 atom % and not more than 1.0 atom % and Zr in an amount of not less than 0.05 atom % and not more than 0.15 atom %.

3. R-T-B-based rare earth magnet particles comprising R (wherein R represents at least one rare earth element including Y), T (wherein T represents Fe, or Fe and Co) and B (wherein B represents boron), and having a composition comprising R in an amount of not less than 12.5 atom % and not more than 14.3 atom %, B in an amount of not less than 4.5 atom % and not more than 7.5 atom % and Co in an amount of not more than 10.0 atom %, in which a squareness ($H_k/H_{cJ}$) of a demagnetization curve of the R-T-B-based rare earth magnet particles is not less than 0.5, and a difference $DB_r$ between a residual magnetic flux density ($B_{r106}$) of oversize particles obtained therefrom using a sieve of sieve opening 106 mm and a residual magnetic flux density ($B_{r38}$) of undersize particles obtained therefrom using a sieve of sieve opening 38 mm is not more than 0.02T.

4. A bonded magnet comprising the R-T-B-based rare earth magnet particles as defined in claim 3.

* * * * *